United States Patent [19]

Gray

[11] 4,450,056

[45] May 22, 1984

[54] RANEY ALLOY COATED CATHODE FOR CHLOR-ALKALI CELLS

[75] Inventor: Thomas J. Gray, Guilford, Conn.

[73] Assignee: Olin Corporation, New Haven, Conn.

[21] Appl. No.: 479,588

[22] Filed: Mar. 28, 1983

Related U.S. Application Data

[62] Division of Ser. No. 324,188, Nov. 23, 1981, Pat. No. 4,419,208.

[51] Int. Cl.[3] ..... C25B 11/08; B01J 35/00

[52] U.S. Cl. ..... 204/98; 204/129; 204/252; 427/123; 427/124

[58] Field of Search ..... 204/98, 129, 252, 290 R, 204/293; 427/123, 124; 429/44; 502/101, 301

[56] References Cited

U.S. PATENT DOCUMENTS

| | | | |
|---|---|---|---|
| 3,379,635 | 4/1968 | Von Doehren | 204/284 |
| 4,116,804 | 9/1978 | Needes | 204/292 |
| 4,170,536 | 10/1979 | Kawasaki | 204/290 R |
| 4,292,159 | 9/1981 | Kuo | 204/292 |

FOREIGN PATENT DOCUMENTS

| | | | |
|---|---|---|---|
| 644910 | 7/1962 | Canada | 204/290 R |
| 122887 | 9/1980 | Japan | 204/293 |

*Primary Examiner*—John F. Niebling

*Attorney, Agent, or Firm*—Arthur E. Oaks; Donald F. Clements

[57] ABSTRACT

An improved cathode with a conductive metal core and a Raney-type catalytic surface predominantly derived from an adherent Beta ($NiAl_3$) crystalline precursory outer portion of the metal core is disclosed. Further, the precursory outer portion preferably has ruthenium added to give a precursor alloy having the formula $(Ni\text{-}Ru)Al_3$ where the ruthenium content of the nickel-ruthenium portion is within the range of from about 5 to about 15 weight percent. Also disclosed is a method of producing a low overvoltage cathode. The method includes the steps of taking a Ni-Ru alloy core or substrate and coating it with aluminum, then heat treating to form a Ni-Ru-Al ternary alloy with mostly a Beta structure and then leaching out the Al to produce a Raney surface.

29 Claims, 5 Drawing Figures

RANEY ALLOY COATED CATHODE FOR CHLOR-ALKALI CELLS

This is a division of application Ser. No. 324,188, filed Nov. 23, 1981, now U.S. Pat. No. 4,419,208.

FIELD OF INVENTION

The invention relates to an improved Raneyized hydrogen evolution cathode for chlor-alkali electrolytic cells.

PRIOR ART STATEMENT

In view of the phenomenal jump in energy costs and the increased scarcity of industrial fuel supplies, there has been and continues to be a flurry of research activity in the electrolysis field to find ways to reduce the amount of power used in electrolysis processes. For many years it has been customary to use steel cathodes in chlor-alkali diaphragm cells, even though a substantial amount of power is used in overcoming what is called "hydrogen overvoltage" at the cathode. Hydrogen overvoltage is largely an inherent characteristic of the metallic surface in contact with the electrolyte so there is a continual need and desire to come up with better cathode surfaces to reduce this overvoltage and thereby decrease the power consumption of the cell.

It is known that active, porous nickel can be produced by selectively dissolving a soluble component, such as aluminum or zinc, out of an alloy of nickel and the soluble component. A porous nickel of this type and the alloy from which it is produced are generally called "Raney nickel" or "Raney alloy" after their inventor. See U.S. Pat. Nos. 1,563,787 (1925), 1,628,191 (1927) and 1,915,473 (1933). There are various methods for producing this Raney nickel, and various applications for this metal are known.

It is also known to use such Raney nickel surfaces on cathodes for chlor-alkali cells. For example, U.S. Pat. No. 4,116,804 filed Nov. 17, 1976 and issued Sept. 26, 1978 to C. Needes and assigned to DuPont describes an electrode, hereafter referred to as the "Needes electrode", for use as a hydrogen evolution cathode in electrolytic cells in which a cohesive surface layer of Raney nickel is in electrical contact with a conductive metal core having an outer layer of at least 15 percent nickel (see Table 4 thereof), characterized in that the surface layer of Raney nickel is thicker than 75 microns and has a mean porosity of at least 11 percent. The catalytic surface layer consists predominantly of Gamma Phase ($Ni_2Al_3$) grains from which at least 60 percent of aluminum has been leached out with an aqueous base. An overvoltage of about 60 millivolts is alleged. To phrase the same thing relative to conventional cathodes, reductions of 315 to 345 millivolts in hydrogen overvoltage as compared with mild steel cathodes is alleged. However, subsequent testing indicates much higher overvoltages and actual reductions of only 100–150 millivolts. Furthermore, spalling or delamination of the coating has been observed upon additional testing. The patent teaches that any Raney nickel which forms from the Beta Phase ($NiAl_3$) is mechanically weak and does not adhere well and is generally lost during leaching. The patent also teaches that Gamma phase is the preferred intermetallic precursor and governs the activity of the coating and that the heat treatment should be such that the proportion of $Ni_2Al_3$ therein is maximized. This reported mechanical weakness of Raney nickel from the Beta phase is unfortunate because it was previously known that Raney Ni prepared with a Beta phase structure is more active for hydrogen desorpotion than is Raney Ni made from a Gamma phase precursor. See for example A. A. Zavorin et al., *Kinetika i Kataliz*, Vol. 18, No. 4, pp. 988–994, (USSR, July-Aug., 1977) which explains hydrogen is more weakly "bonded" in Raney Ni from $NiAl_3$ than from $Ni_2Al_3$, that there are more hydrogen adsorption centers in Raney Ni from $NiAl_3$ than $Ni_2Al_3$ and that the heat of desorption is lower for Raney Ni from $NiAl_3$ than from $Ni_2Al_3$.

Golin, Karaseva and Serykh in *Electrokhimiya*, Vol. 13, No. 7, pp. 1052–1056 (USSR, July, 1977) disclose a 10 percent Mo, 45 percent Ni, 45 percent Al alloy which, upon leaching, yields a Raney catalytic surface with extremely low activation energy for hydrogen oxidation such as would occur in a hydrogen-oxygen fuel cell. No mention of hydrogen evolution (i.e. hydrogen reduction) catalysis is given or suggested.

Austrian Patent 206,867 issued Dec. 28, 1959 to Ruhrchemie A. G. and Steinkohlen Electrizitat A. G. gives a detailed discussion of preparation of thin foil electrodes with a "double-skeletal catalyst" coating of 20–80 percent Raney metal with 80–20 percent skeletal material (e.g. Ni powder). Page 3, column 2 lists a number of sintered powder metal alloys suitable for catalytic coatings on the foil. German Auslegeschrift 1,094,723 by W. Vielstich, E. Justi and A. Winsel-Ruhrchemie A. G. published Dec. 15, 1960, suggests (page 3, lines 24–70) use of such a "double skeletal catalyst" coated foil improved by adding (page 3, lines 54–63) 1–20 percent of a Group VIII metal as the cathode of an amalgam decomposer of a mercury type chlor-alkali cell system. However, such sintered coatings have been found to delaminate after relatively short use as diaphragm or membrane cell cathodes.

Baird and Steffgen in *Ind. Eng. Chem., Prod. Res. Dev.*, Vol. 16, No. 2 (1977) in an article entitled "Methanation Studies on Nickel Flame-Sprayed Catalysts", describe the temperature ranges for the various intermetallics and say $NiAl_3$ is the major phase produced during heat treatments for 1, 10 or 30 minutes at about 725° C. and that no more than 10 minutes is required at 725° C. for alloying. When heat treated at 725° C., the alloy was found to have the greatest activity for carbon monoxide conversion catalysis (see FIG. 2 thereof). $NiAl_3$ is described as believed to be the most active intermetallic phase "as shown by Petrov et al (1969)" and photomicrographs are provided to show the structure.

U.S. Pat. No. 4,033,837 issued to Kuo et al. on July 5, 1977 teaches use of a Ni-Mo-V catalytic coated copper cathode which achieves a relatively low overvoltage. While this cathode has a significantly lower overvoltage than a steel electrode, copper-fouling or iron-fouling can be a problem unless the catholyte solution is kept free of iron. No mention of Raney treatment is made.

U.S. Pat. No. 3,291,714 issued to Hall on Dec. 12, 1966 discloses a number of coatings for steel or titanium cathodes, among such coatings a Ni-Mo coating and a Fe-Ni-Mo coating were found most desirable. Heat treatment of the electrodeposited coating was required to avoid delamination of the coatings. Moderately low overvoltages were alleged. No mention of Raney treatment is given.

West German Offenlengungsschrift 2,704,213 published Aug. 11, 1977 claiming priority of U.S. Serial No. 655,429 filed Feb. 2, 1976 by Macmullin discloses a Raney-nickel cathode in the form of a plate or a porous Raney-Ni coated perforated nickel plate. The cathode is designed for chlor-alkali membrane cells, but was, as stated in the example therein, apparently only tested in "a small laboratory cell". The cathode is prepared by creating a nickel-aluminum alloy, pouring a plate of the alloy and then leaching out the aluminum. Ruthenium is not mentioned.

W. Vielstich in *Chem. Ing. Techn.*, Vol. 33, pp. 75–79, (1961) describes a "dual-frame" electrode made of Raney nickel, which is prepared by mixing a powdered Raney alloy (e.g. of nickel and an alloying component, such as aluminum) with a frame metal consisting of pure metal powder (e.g. carbonyl-nickel), pressing, sintering, and then dissolving out the alloying component from which the Raney alloy is prepared. The surface layer of such an electrode consists of a dispersion of active Raney nickel particles, which is embedded in a frame made of inactive solid nickel particles. This electrode is used, among other things, as a hydrogen evolution cathode in a chlorine-alkali electrolysis diaphragm cell. Double-frame electrodes produced by the methods of powder metallurgy, however, have insufficient mechanical strength to be suitable for producing large mesh electrodes such as those which are desired for industrial scale electrolysis of sodium chloride solutions.

One process for producing flat material from Raney nickel comprises the steps of spraying fused particles of a Raney alloy precursor (e.g., an alloy of nickel and aluminum) are sprayed onto a metallic carrier or substrate with aluminum being selectively dissolved out; see U.S. Pat. No. 3,637,437 issued to Goldberger. This material is suggested as a material for catalytic cathodes of fuel cells. Cathodes produced according to this method, however, generally have surfaces of low porosity and have a tendency to break apart.

U.S. Pat. No. 3,272,728 and German Offenlegungsschrift No. 2,527,386 (based on U.S. patent application Ser. No. 489,284) describe electrodes with Raney nickel surfaces which are produced by simultaneously electrodepositing nickel and zinc from an inorganic electrolyte bath on a metal carrier (such as steel) and then selectively dissolving zinc out of the Ni-Zn alloy thus produced. This electrode treatment is supposed to reduce hydrogen overvoltage of steel cathodes by up to 150 millivolts. U.S. Pat. No. 4,104,133 issued Aug. 1, 1978 discloses one method alleged to be useful to put this Ni-Zn Raney coating technology into commercial practice by use of metallic plating anodes for deliberately electroplating a Ni-Zn coating onto the cathode in-situ in a chloralkali cell and subsequently leaching the zinc out to give a Raney nickel surface and lower the hydrogen overvoltage of the chlor-alkali cell. However, only layers of a very crude temporary Raney alloy form. Permanent coatings of greater overvoltage reductions are desired.

British Pat. No. 1,289,751 describes a process for producing porous nickel electrodes for electrochemical cells or fuel cells by electrodeposition of aluminum from an electrolyte containing an organoaluminum complex on a support made of nickel or a nickel alloy, wherein some of the aluminum deposited diffuses into the nickel, forming an alloy, from which aluminum is then leached. The diffusion is carried out over a period of 1 or 2 hours in an inert atmosphere at a temperature of less than 659° C., preferably between 350 and 650° C. Very thin electrodeposited layers, 5–20 microns thick are described.

J. Yasamura and T. Yoshino in a report on "Laminated Raney Nickel Catalysts" in *Ind. Chem. Prod. Res. Dev.*, Vol. 11, No. 3, pp. 290–293, 1972, describe the production of Raney nickel plates, though not in connection with electrodes, by spraying molten aluminum onto a nickel plate, heating for 1 hour in a nitrogen atmosphere at 700° C. to form a 0.2 mm-thick layer of $NiAl_3$ and dissolving aluminum out of the layer. The product thus obtained is supposed to be usable as a hydrogenation (i.e. hydrogen oxidation) catalyst.

Another method of preparing molded articles from Raney nickel for use as hydrogenation catalysts is described in U.S. Pat. No. 3,846,344 issued to Larsen. According to this patent, a nickel-plated metal pipe is coated with an aluminum layer at least 0.02 mm thick, then the aluminum is permitted to diffuse into the nickel by heat treating for at least 30 minutes at a temperature of at least about 480° C. and then the aluminum is selectively dissolved out of the diffusion layer. Example 5 of the patent describes how a 25 mm-diameter pipe with a 1 mm-thick electrodeposited nickel layer, on which a 0.5 mm-thick aluminum layer has been deposited by flame spraying, is subjected to 6 hours of diffusion heat treatment at 650° C., in order to produce a diffusion layer at least 0.05 mm thick. The pipe is then activated by immersing for 8 hours in 25 percent aqueous sodium hydroxide solution. The patent states that the surface displays a high degree of efficacy for the catalytic hydrogenation of benzene to produce cyclohexane.

U.S. Pat. No. 3,407,231 describes a process for producing a negative electrode with an active porous nickel surface for use in alkaline batteries. According to the patent, the electrode is produced by bringing aluminum into contact with the surface of a nickel-containing core at an elevated temperature, so that nickel and aluminum interdiffuse to form a layer of Gamma phase nickel aluminide ($Ni_2Al_3$), after which the aluminum which has diffused in is dissolved out with alkali metal hydroxide and a layer of active nickel is obtained, which is metallurgically bonded to the core. The patent mentions diffusion temperatures of 625 to 900° C., diffusion times of 8 to 16 hours, dissolution temperatures of 20 to 100° C., dissolution times of 1 to 32 hours, and coating thicknesses of 200 to 300 microns. In particular, the process is supposed to be carried out by placing a nickel sheet in a packet made of a mixture of about 58 percent $Al_2O_3$, 40 percent aluminum powder, and 2 percent $NH_4Cl$ and heating the packet for 8 hours in a reducing atmosphere at 800° C., so that a 200 micron thick layer of $Ni_2Al_3$ forms on each side of the nickel sheet, after which the coated nickel core is immersed in 6 N sodium hydroxide for about 16 hours at 80° C., in order to dissolve out at least 85 percent of the aluminum. However, it has been found that Raney nickel surfaces of electrodes produced according to this special method have low porosity. The patent suggests that the nickel sheet be rolled between two aluminum sheets in order to produce a metallic bond, and the sandwich be heated in a reducing atmosphere at 543° C. Although temperatures below 649° C. are preferred in this particular embodiment, the patent also suggests temperatures of as high as 872° C. It has been found, however, that in the case of bonding by rolling the desired metallic bond does not form.

U.S. Pat. Nos. 4,043,946 issued Aug. 23, 1977 to Sanker et al. and 4,049,580 issued Sept. 20, 1977 to Oden et al., both describing work at the Bureau of Mines in Albany, Oregon and being assigned to the United States Government, disclose the production of relatively thick beta nickel layers on a gamma nickel intermediate layer which, in turn, is on a nickel substrate to produce a supported catalyst. In the U.S. Pat. No. 4,043,946 the method involves placing a nickel substrate in a mold having a cavity somewhat larger than the substrate and heating the mold to 1050° C. in a furnace. Molten aluminum at a temperature of 850° C. is poured into the mold cavity and the temperature of the mold is kept at 1050°C. for about 30 seconds. Thereafter, the mold is removed from the furnace and allowed to cool to ambient temperature, after which it is leached with sodium hydroxide to produce the Raney surface. The nickel substrate may contain up to 5% of a minor alloying element such as, for example, molybdenum, cobalt or rhenium.

In U.S. Pat. No. 4,049,580, a precursor is formed by coating a nickel substrate with molten aluminum or aluminum nickel alloy to form the specimen, then heat treating above the melting point of aluminum and quenching at a temperature which favors the formation of $NiAl_3$, after which the specimen is leached. In this process the heat treatment temperature is preferably 1050°–1080° C. and the quench temperature is preferably 700° C. Both the heat treatment and quench are preferably performed in molten salt baths with 1 to 3 seconds comprising the heat treatment time and about 30 seconds comprising the quench time. The use of alloy materials to enhance the formation or stabilization of the beta structure is not disclosed in this patent. Neither of these patents makes reference to the use of these materials as cathodes in chlor-alkali cell environments.

It is an object of this invention to provide an improved cathode for use in a chlor-alkali membrane or diaphragm cell which has a reduced cathode polarization potential ("hydrogen overvoltage") for extended periods.

It is a further object of this invention to provide a relatively simple and inexpensive process for preparing a cathode having primarily a Beta Raney nickel-alloy structure on its surfaces.

These and other objects of the invention will become apparent from a consideration of the following description and the appended claims.

SUMMARY OF THE INVENTION

One embodiment of the present invention is an improved low overvoltage electrode for use as a hydrogen evolution cathode in an electrolytic cell, the electrode being of the type that has a Raney metal surface layer in electrical contact with a conductive metal core, wherein the improvement comprises a porous Raney metal surface layer predominantly derived from adherent Beta structured crystalline precursory surface alloy layer having a general formula of $(Ni\text{-}Ru)Al_3$, where the weight percentage of ruthenium in the nickel-ruthenium portion is between 5 and 15%.

Another embodiment of the present invention is an improved low overvoltage anti-fouling electrode for use in a hydrogen evolution cathode in an electrolytic cell, the electrode being of the type that has a Raney metal surface layer in electrical contact with a conductive metal core, wherein the improvement comprises a porous Raney metal surface predominantly derived from an adherent $NiAl_3$ (Beta phase) crystalline intermetallic alloy layer which is stabilized by the substitution of a stabilizing amount of ruthenium within the crystalline structure of said intermetallic alloy layer.

Yet another embodiment of the invention is a method of producing a low overvoltage electrode for use as a hydrogen evolution cathode in an electrolytic cell which comprises the steps of:

(a) coating with aluminum the surface of a clean non-porous conductive base metal structure of an alloy of about 5–15 percent by weight of ruthenium and about 95–85 percent by weight nickel;

(b) heat treating said coated surface by maintaining said surface at a temperature of from 660° to 750° C. for a time between about 1 minute and about 30 minutes so as to diffuse a portion of said aluminum into outer portions of said base metal and produce an integral nickel-ruthenium-aluminum alloy layer on said surface comprised of an outer portion consisting predominantly of Beta structured grains and further having an inner portion consisting predominantly of Gamma structured grains in said alloy layer; and (c) leaching out residual aluminum and intermetallics from the alloy layer until a Raney nickel-ruthenium alloy layer is formed integral with said structure.

BRIEF DESCRIPTION OF THE DRAWINGS

The invention will be better understood by way of reference to the attached illustrations in which.

DETAILED DESCRIPTION OF THE INVENTION

Figure 1:
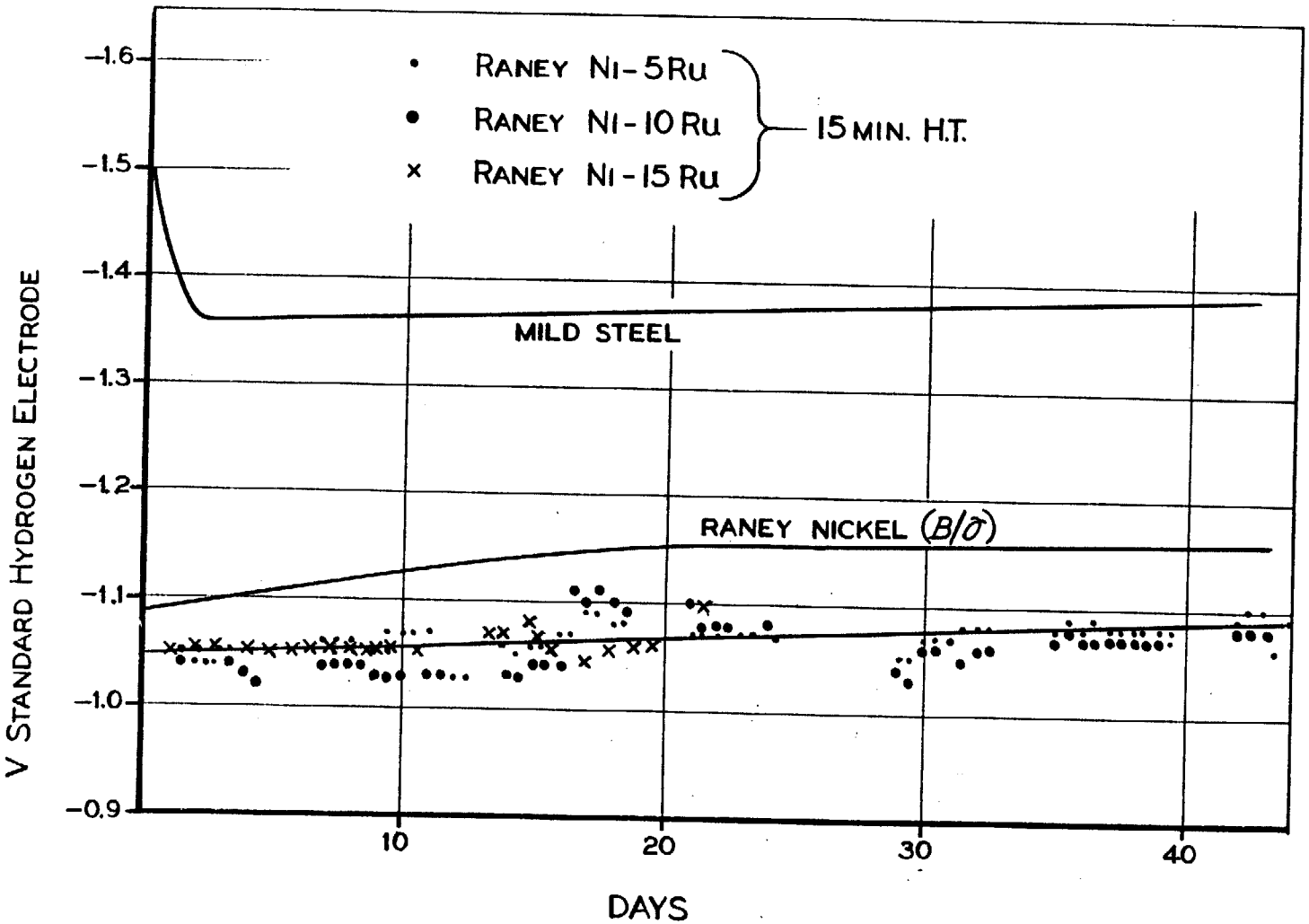
FIG. 1 is a graph of polarization potential (ref standard hydrogen electrode) vs time for a number of cathodes.

FIG. 1 graphically shows the cathode polarization potential using 3 different nickel ruthenium alloy beta alloy structured Raney cathodes of the present invention as compared to an unalloyed Raney nickel and a mild steel cathode is a typical chlor-alkali cell environment. The Raney coating of the present invention had between 200–250 millivolts less potential as compared to the steel cathode. This overvoltage difference was maintained for approximately six weeks and the Raney nickel-ruthenium structures did not exhibit any appreciable thinning or appear to have any appreciable iron fouling. The constant overvoltage level is believed to be a result of the surprisingly unexpected nature of the coating during actual performance.

The overvoltage reductions are based on operation of the electrode as the cathode in a brine electrolysis cell at a current density of 200 milliamps per square centimeter which is typical of current densities found in many conventional diaphragm and membrane type chlor-alkali cells.

It is also seen that the mild steel sample, which started at an overpotential of about 560 millivolts relative to the standard reversible hydrogen potential of 0.94 V DC (−0.94)−(−1.500/volts), actually decreased in overpotential and then started rising gradually. The explanation is the overplating of iron which has been recently found by others to cause increased roughness and has lower actual current density and therefore lower overvoltage. It is known that overvoltage generally decreases when current density decreases.

Figure 2:
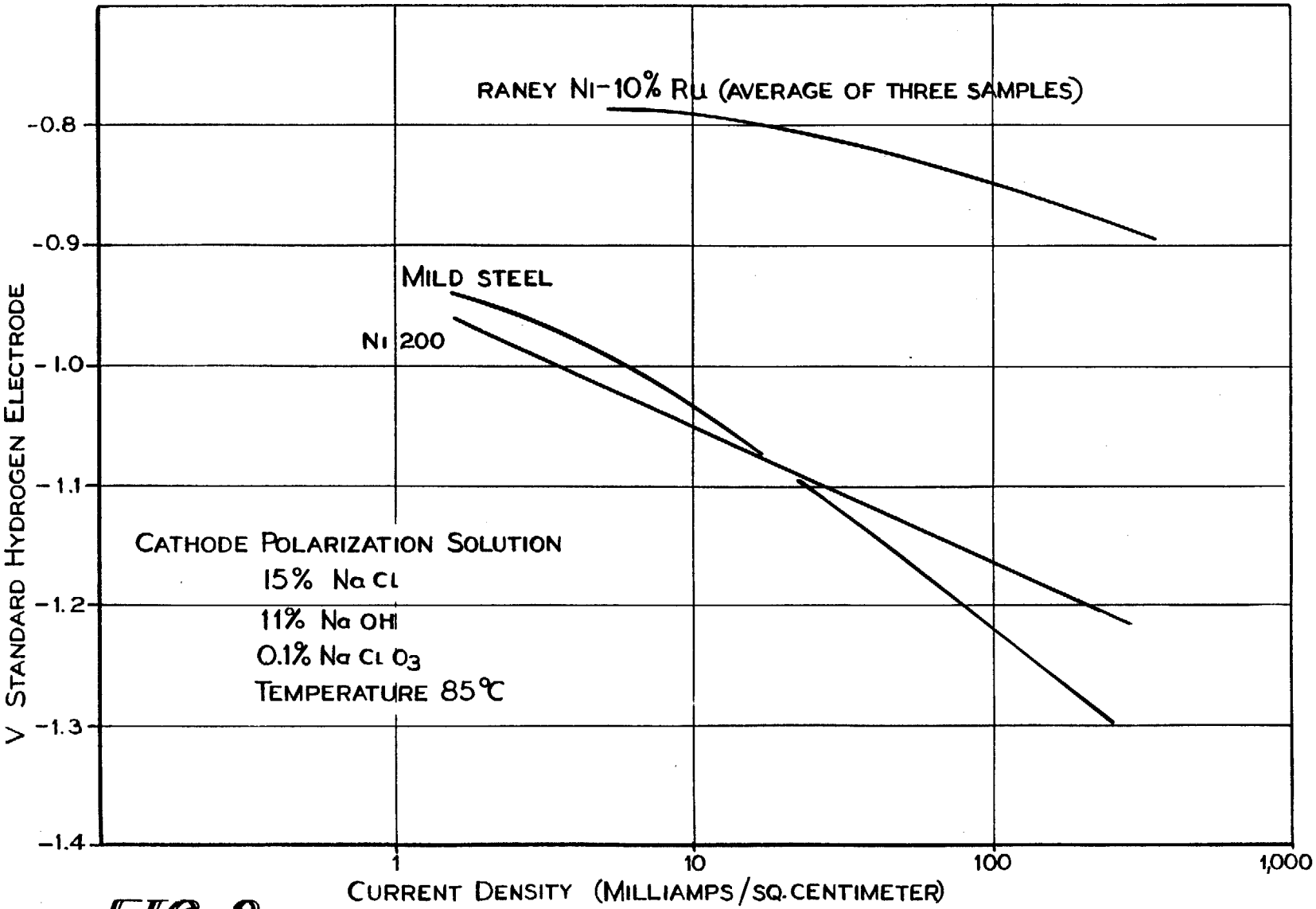
FIG. 2 is a graph of the polarization potential of a cathode of the present invention vs current density as compared to non-Raney treated cathodes and a standard hydrogen electrode in a catholyte representative of diaphragm cells.
Figure 3:
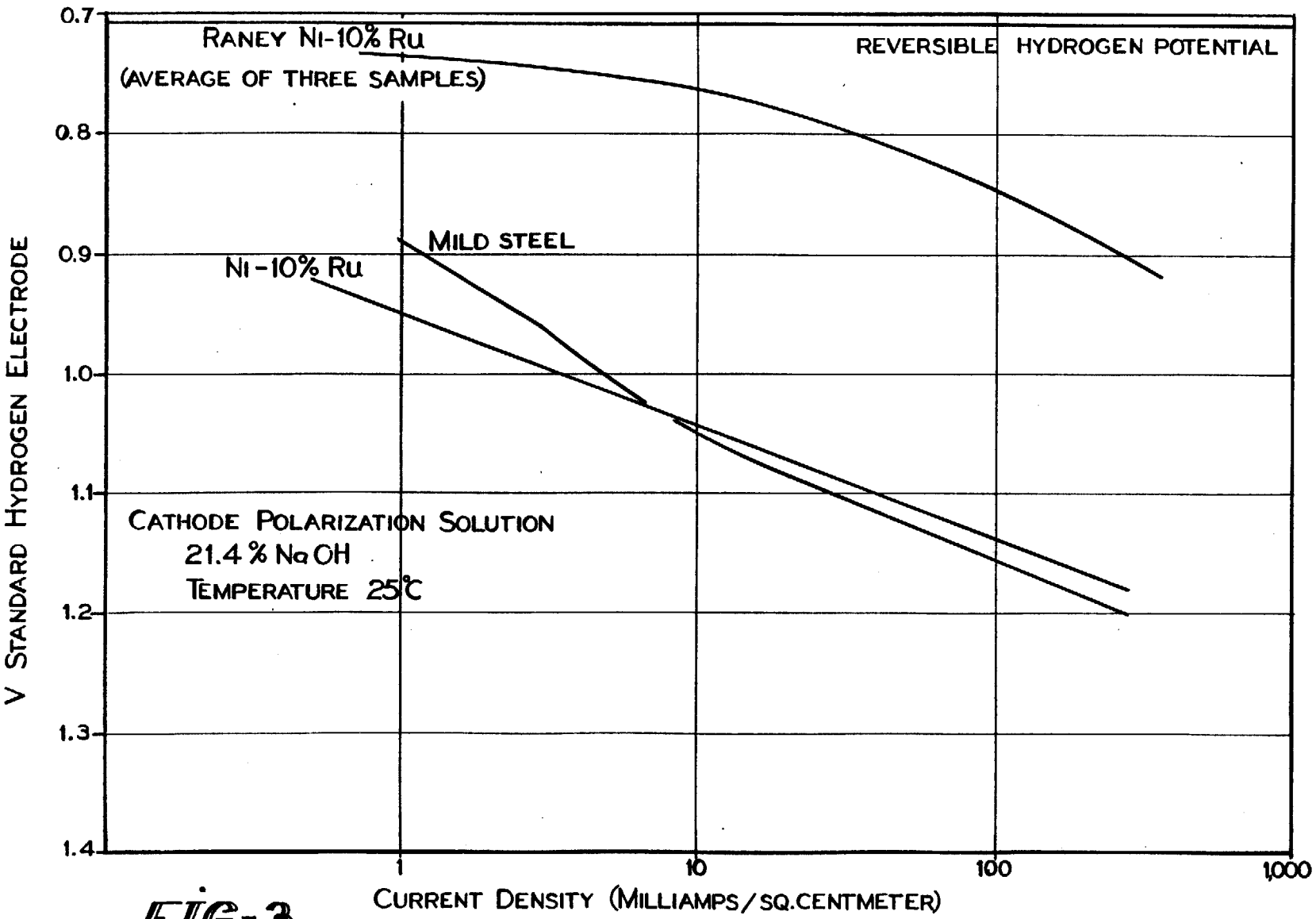
FIG. 3 is a graph of the polarization potential of a cathode of the present invention vs current density as compared to non-Raney treated cathodes and a standard hydrogen electrode in a catholyte representative of membrane cells.

FIGS. 2 and 3 show the overpotential curves versus current density for catalytically coated cathodes of the invention all prepared from a nickel ruthenium aluminum ternary alloy Beta phase precursor wherein the alloy has about 10 percent ruthenium ("Ni-10 Ru"). FIG. 2 shows a comparison of this alloy with a conventional steel cathode in a catholyte having a composition essentially that of a commercial chlor-alkali diaphragm cell. FIG. 3 is a similar plot except that the catholyte is essentially that of a commercial chlor-alkali cell having a permselective membrane separating the anolyte and catholyte compartments thereof. In both instances it is seen that the overpotential with a cathode of this invention is superior by about 0.2 V as compared to the other cathodes shown at low (1 ma/cm$^2$) current densities, and as the current density increases, so does the difference between the standard steel and Raney Ni-10Ru cathode, said difference increasing a value of about 0.3 to 0.35 V at 200 ma/cm$^2$.

Figure 4:
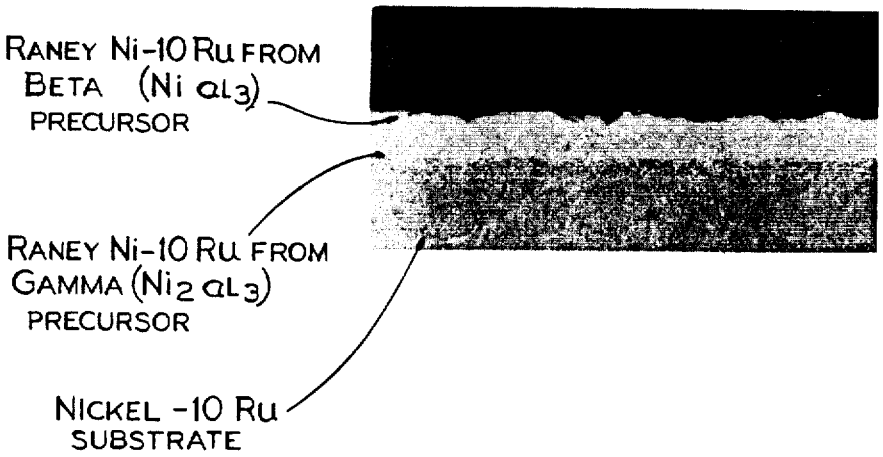
FIG. 4 is a 500X photomicrograph of the coating of a cathode of the present invention showing a predominance of $Ni_{90}Ru_{10})$ $Al_3$ (Beta Phase) precursor as it appears after heat treatment and annealing prior to leaching.

FIG. 4 presents a photomicrograph of a cross section of the Beta Raney Ni-10Ru cathode formed from an interdiffused nickel ruthenium aluminum Beta phase alloy layer that was formed by dipping a Ni-10Ru substrate to molten aluminum and interdiffusing the aluminum into the substrate at about 725° C. for about 10 minutes. The photomicrograph shows a Ni-10Ru core, upon which is a relatively thin layer of Gamma Raney material atop of which is a comparatively thick layer of Beta Raney material. It is seen that the Raney Ni-10Ru layer is 2-3 times as thick as the Gamma Raney Ni-10 Ru layer and that the Beta Raney Ni-10Ru layer is the outer layer and thus will be the layer in contact with any electrolyte in which the coated core is placed as an electrode. Thus the Beta Raney-Ni10Ru controls the activity of the coating. Since the Beta Raney Ni-10Ru predominates and controls, this whole coating of FIG. 4 is collectively called a Beta Raney Ni-10Ru coating.

It has been shown that in the diffusion of aluminum into a nickel bearing substrate at a temperature of about 600° C. or higher, a given weight of Gamma phase ($Ni_2Al_3$) has about 50% less aluminum than the same weight of Beta phase ($NiAl_3$). Where there is an unlimited reservoir of aluminum and the alloying temperature is within a 660° C. to 860° C. range, a Beta structure layer forms adjacent to the aluminum reservoir with a Gamma structure forming underneath. This can be found to occur even at temperatures as low as 600° C. if the treatment time is long enough. However, at such a low temperature, the Beta layer is only 5-10 microns thick while the Gamma layer is about 35 microns thick. This situation is not unique and a preponderance of Gamma phase material will form at higher temperatures as well given a sufficient heat treatment time. However, where a Ni 5-15 wt. % Ru alloy is used it is found that the Beta phase predominates. It is thus believed that ruthenium stabilizes the Beta phase so as to yield a constant surprisingly low overvoltage upon subsequent leaching.

The metallic core or substrate which comprises the starting material for the electrode is prepared to have a nickel ruthenium alloy bearing outer layer with which it is in electrical contact wherein the ruthenium concentration is between about 5% and about 15% and preferably at least about 8% to about 12%, said alloy being nominally 10% Ru by weight and identified as Ni-10Ru. This can be any conductive metal or alloy but is preferably nickel or nickel ruthenium alloy so that the substrate itself forms the coating after Raney treatment. For cores of other metals or alloys, a nickel ruthenium coating can be deposited on the core by known techniques such as metal dipping, electroplating, electroless plating, and the like. When the core is of substantially pure nickel or an appropriate nickel bearing alloy such as Inconel 600, Hastalloy C or 310 stainless steel, the core inherently has a nickel bearing outer layer to which ruthenium may then be added by electroplating, plasma spraying, or other suitable means. Where the nickel bearing material is a homogeneous alloy such as the Ni 5-15Ru alloy of the present invention it is most preferred to have the outer portions of the core (core is used interchangeably herein with substrate) itself serve as the nickel bearing outer layer. This helps eliminate or reduce spalling of the coating by eliminating or reducing the possibility of corrosion at the interface between the outer layer and core by making the interfacial transition much less abrupt. The alloy nickel bearing outer layer of the core, whether provided by the core metal itself or as a deposited coating is conveniently at least 100 microns thick, and preferably at least 150 microns thick. The maximum thickness of this outer layer is a matter of convenience and economic choice.

Although cores in the form of screens or plates, especially screens are preferred, cores made from foils, wires, tubes, or expanded metal are also suitable.

Electrodes of the present invention are prepared by a process wherein an interdiffused nickel ruthenium aluminum ternary alloy layer is formed, from which aluminum is subsequently selectively leached. This process includes the steps of (a) preparing a metallic core with a nickel bearing ruthenium alloy outer layer, (b) aluminizing the surface of the core, (c) heat treating said aluminized nickel ruthenium alloy surface, so as to cause the aluminum to diffuse thereinto, (d) selectively leaching of aluminum from the interdiffused material, (e) optionally chemically treating said leached surface to prevent potential pyrophoricity and (f) optionally coating said leached surface with nickel to improve its mechanical properties. In performing this process the nickel ruthenium bearing surface of the core must be thoroughly cleaned by conventional means such as chemical cleaning and/or grit blasting so as to improve the bond between the nickel ruthenium surface of the core and the subsequently applied aluminum layer.

The clean surface of the core is next subjected to an aluminizing treatment. By "aluminizing," as used herein is meant that aluminum is brought into intimate contact with the core surface so that when subsequently heated to promote interdiffusion the desired nickel-ruthenium-aluminum ternary alloy layer is formed. Aluminizing can be accomplished by any of several known methods, such as plasma spraying aluminum onto the surface of the core, dipping the core into an aluminum melt or by use of fused salt electrolysis. Whichever method is used, an aluminum layer of at least 100 microns thickness is deposited on the surface of the core. Much thicker aluminum layers, of, for example, greater than 500 micron thicknesses, perform satisfactorily in the process but for reasons of economy, aluminum layer thicknesses of between about 150 to about 300 microns are preferred.

Dipping is preferred to apply the aluminum since it has been found to yield the lowest overvoltage coating upon subsequent Raney treatment and is the treatment most easily applied to expanded metal cathodes. Where this is done, the previously cleaned alloy surface is first coated with a low melting point flux typically comprising 51 wt. % KCl, 40 wt. % LiCl, and 9 wt. % cryolite. This has a melting point of about 350 C. The core is then dipped into a pot of molten aluminum held at a temperature range of between about 650° C. and about 675° C. for between about 0.5 and 2.0 minutes, said time being sufficient to uniformily coat the core with an aluminum thickness as defined above.

Interdiffusion is carried out by heat treating the aluminized structure at a temperature in the range from about 660 to about 750° C. Preferably the temperature within the range of from about 700° C. to 750° C. is employed, and particularly from about 715° C. to 735° C. being most preferred. Usually the interdiffusion is carried out in an atmosphere of hydrogen, nitrogen, or an inert gas. This interdiffusion treatment is continued for a time sufficient for the aluminum and nickel alloy to interdiffuse and form a nickel-ruthenium-aluminum ternary alloy of between 100 and 400 microns in thickness with best results being obtained when the thickness is between 150 and 300 microns. Heat treatment is stopped after a time of between about 1 minute and 30 minutes and preferably between about 5 to about 20 minutes so that only a minimum of Gamma phase structured material tends to form.

The size of the Gamma structure range and the rate at which the Gamma-containing layer grows are highly dependent on whether the aluminum layer is depleted and the length of the heat treatment as well as on the temperature at which the aluminum and nickel alloy are interdiffused. Larger grain sizes have much faster buildup of the Gamma-containing layer accompany the use of temperatures of 750° C. or more. When temperatures above about 860° C. are used it is known that Beta phase material transforms into liquid and Gamma phase material.

For coatings on an underlying substrate differing in composition from the surface, extended heat treatments might damage the substrate and form undesirable brittle intermetallics at the coating substrate interphase. For example, if aluminum is diffused into a nickel alloy coated steel core, excessive interdiffusion time or temperature can result in the aluminum "breaking through" to the steel base of the core, i.e., the aluminum diffused all the way through the coating into the steel core. Break-through is accompanied by the formation of a very brittle $FeAl_3$ intermetallic phase which can significantly undermine the strength of the bond between the core and the interdiffused layer.

Also, if interdiffusion is continued too long, all of the available aluminum can be diffused into the nickel such that there is still a large excess of nickel in the interdiffused material. Under these latter circumstances, or when interdiffusion temperatures of above about 1000° C. are used, an intermetallic phase forms, which does not permit satisfactory subsequent leaching of the aluminum from the intermetallic, and consequently a highly active porous nickel does not form. By providing sufficient quantities of nickel alloy and aluminum with a heat treatment that avoids both an excessively long treatment time or an excessively high temperature during interdiffusion, both break-through and formation of these undesirable intermetallics are avoided.

As described above, the aluminizing and interdiffusion steps are carried out sequentially. However, the steps can also be performed simultaneously by pack diffusion techniques. For example, a mixture of aluminum and alumina powders and an activator can be packed around a nickel-ruthenium core and then heated in a hydrogen atmosphere at a temperature of 750° C. for about 8 hours to form a nickel-ruthenium-aluminum ternary alloy layer having the desired composition and structure.

The formation of the desired nickel ruthenium aluminum ternary alloy layer is followed by a selective leaching step, wherein sufficient aluminum is removed from the surface and the nickel ruthenium aluminum alloy layer forms a nickel alloy surface layer. Generally, a strong aqueous base, such as NaOH, KOH or other strongly basic solution capable of dissolving aluminum is used in the selective leaching step. Preferably the selective leaching is carried out in an aqueous caustic solution containing about 1 to about 30% by weight of NaOH. For example, a selective leaching treatment of 20 hours of NaOH at ambient conditions (i.e., temperature is not controlled) or a treatment of 14 hours in 10% NaOH at ambient temperature followed by 6 hours in 30% NaOH at 100° C. has been found satisfactory for producing porous nickel alloy surfaces of the invention. A preferred selective leaching procedure is carried out first 2 hours in 1% NaOH, then for 20 hours in 20% NaOH. Both of these substeps under conditions in which the temperature is not controlled and finally for 4 hours in 30% NaOH at 100° C. The leaching procedure removes at least about 60%, and preferably between about 75–95% of the aluminum from the interdiffused ternary alloy layer and provides a porous nickel alloy surface of unusually high electrochemical activity. It is recognized that the leaching conditions can be varied from those mentioned above to achieve selective dissolution of the aluminum.

After the selective leaching, the active nickel alloy coating may exhibit a tendency to heat when exposed to air. This self-heating tendency could possibly lead to problems in pyrophoricity. However, an optional step of chemically treating the porous nickel layer can be used to eliminate this potential problem. Convenient methods for this chemical treatment include immersing the porous nickel surface for at least 1 hour and usually less than 4 hours in a dilute aqueous oxidizing solution containing, for example, by weight (a) 5% $H_2O_2$, (b) 3% $NaNO_3$, (c) 3% $K_2Cr_2O_7$ or (d) 3% $NaClO_3$ and 10% NaOH. These treatments eliminate the hot self-heating tendency of the porous nickel alloy surface without diminishing its electrochemical activity or mechanical properties.

Although the active porous alloy surface layers, as prepared by the preceding steps have satisfactory mechanical properties and low tendency to spall, compared with many of the Raney nickel surfaces of the prior art, the mechanical properties of the layer can even be improved by optionally coating a very thin layer of nickel onto the porous surface. The nickel layer, which is preferably 5 to 10 microns thick, can be applied from conventional electroless nickel or nickel electroplating baths and enhances the mechanical strength of the porous nickel alloy layer without diminishing its electrochemical activity.

Electrochemical Test Cell

Figure 5:
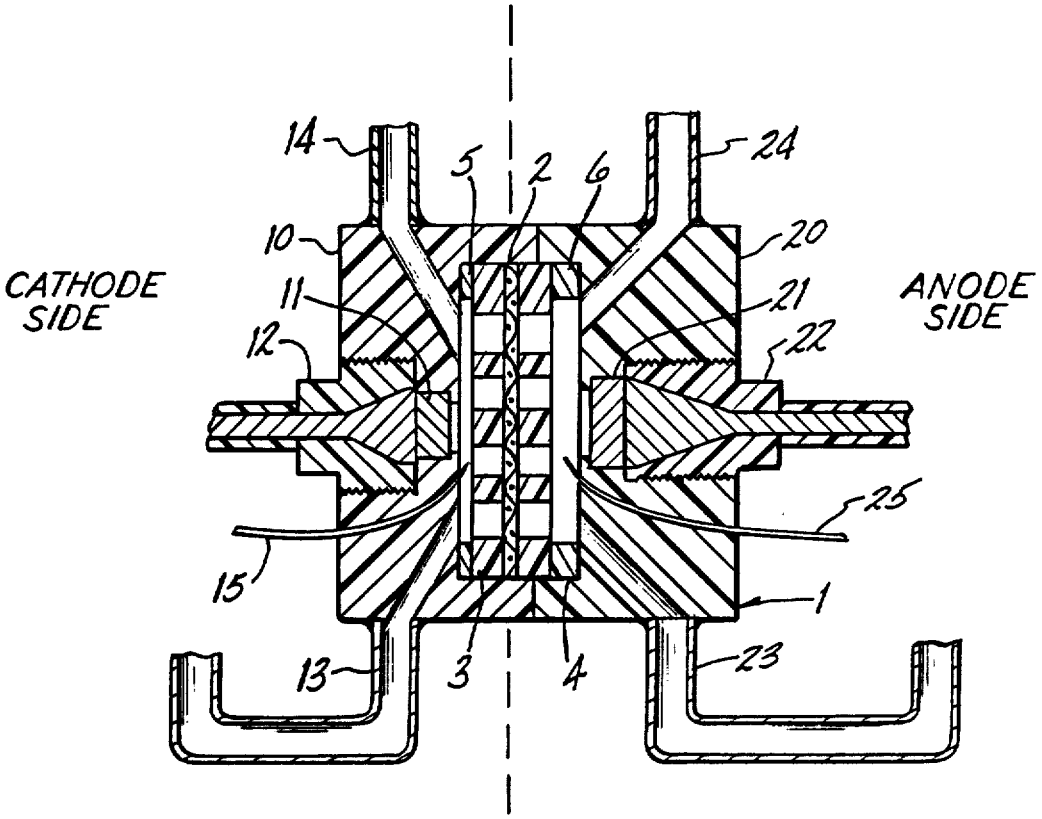
FIG. 5 is a vertical cross section through an exemplary laboratory electrolysis cell with which the present invention may be used.

FIG. 5 is a sectional schematic diagram of an electrochemical test cell, used for measuring the cathode potentials of the various cathode electrodes of the examples below.

Test cell 1, made of tetrafluoroethylene ("TFE"), is divided by a selected permselective membrane 2 into two chambers, cathode chamber 10 and anode chamber 20. In this example, membrane 2, which is placed between two TFE separators 3 and 4 sealed in place by caustic resistant gaskets 5 and 6, respectively, is made of a homogeneous film 7 mils thick of 1200 equivalent weight perfluorosulfonic acid resin which has been chemically modified by ehtylene diamine converting a depth of 1.5 mils to the perfluorosulfonamide laminated with a "T-12" tetrafluoroethylene filament fabric, marketed by the DuPont Company under the trademark Nafion ® 227. Although the test cell was operated with a membrane the electrode of this invention is also useful in electrolytic cells which utilize diaphragms as well.

A circular titanium anode 21 of two square centimeters area coated with a titanium oxide-ruthenium oxide mixed crystal is installed at the end of the anode current collector 22 in anode chamber 20. Cathode 11 of test cell 1 is installed at the end of cathode current collector 12 in cathode chamber 10. Perforated tetrafluoroethylene separators 3 and 4 and gaskets 5 and 6 are placed between membrane 2 and anode 21 and cathode 11, respectively.

A circular area of one square centimeter of the porous Raney nickel alloy surface of the test cathode 11 is exposed to the interior of cathode chamber 20. Cathode 11 and anode 21 are connected electrically to controllable voltage source by cathode current collector 12 and anode current collector 22. An ammeter (not shown) is connected in the line between the two electrodes. The entire cell 1 is then immersed in a liquid bath which is thermostatically controlled to give a constant operating temperature of about 85° C.

Catholyte, consisting of an aqueous solution containing about 11 weight percent sodium hydroxide, 15 weight percent sodium chloride and 0.1 weight percent sodium chlorate, (thereby simulating a diaphragm cell electrolyte), is pumped through inlet 13 into the cathode compartment at a rate which establishes an overflow through outlet 14. The catholyte is maintained at 85° C. Similarly, anolyte consisting of an aqueous brine solution having a pH of about 1.5 and containing 24–26 weight percent sodium chloride, is pumped through inlet 23 into the anode compartment and overflowed through outlet 24. The salt concentrations of the catholyte and anolyte are typical of that encountered in commercial diaphragm cells used in the electrolysis of brine. The use of separate catholyte and anolyte feeds, rather than a single brine feed, assures better control of the desired catholyte composition. The catholyte and anolyte flows are controlled so that there is a small flow of solution from the anode to the cathode compartment, which flow is sufficient to assure ionic conductivity across the cell, but insufficient to significantly affect the catholyte composition.

Luggin tetrafluoroethylene capillary 15, installed in the cathode chamber 10 and Luggin capillary 25, installed in the anode chamber 20 are positioned ½ mm from the membrane surface and are each connected to a mercury-mercury oxide reference electrode and to a standard calomel electrode respectively (not shown), which in turn are connected through a voltmeter (not shown) to the respective electrode of cell 10. A Luggin capillary is a probe which, in making ionic or electrolytic contact between the anode or cathode and the reference electrode, minimizes the voltage drop due to solution resistance and permits direct measurement of the anode or cathode potential with respect to the reference electrode.

To determine the cathode potential of a test electrode, a voltage is impressed between the anode and test cathode, such that a current density of 200 ma/cm$^2$ is established at the cathode. The current density is the current measured by the ammeter in milliamps divided by the area (i.e., 1 cm$^2$) of the porous Raney nickel alloy surface of the test electrode exposed to catholyte. Thus 200 ma would be applied to cathode 11 to achieve a current density of 200 ma/cm$^2$. Hydrogen gas, generated at the cathode is removed from the cathode compartment though catholyte outlet 14. Chlorine gas, generated at anode 21, is similarly removed through anolyte outlet 24. The cell is operated in this manner for at least 2 hours prior to reading the cathode potential directly from the voltmeter.

Membranes which are useful in electrolytic cells for the electrolysis of brine which employ the novel cathode having the Raney nickel alloy surface described above include amine-substituted polymers, unmodified perfluorosulfonic acid laminates, homogeneous perfluorosulfonic acid laminates and carboyxlic acid substituted polymers.

The first group of membranes includes amine substituted polymers such as diamine and polyamine substituted polymers of the type described in U.S. Pat. No. 4,030,988, issued on June 21, 1977 to Walther Gustav Grot and primary amine substituted polymers described in U.S. Pat. No. 4,085,071, issued on Apr. 18, 1978 to Paul Raphael Resnick et al. Both of the above patents are incorporated herein in their entirety by reference.

With reference to the diamine and polyamine substituted polymers of U.S. Pat. No. 4,030,988, supra, the basic precursor sulfonyl fluoride polymer of U.S. Pat. No. 4,036,714, issued on July 19, 1977 to Robert Spitzer, and incorporated herein in its entirety by reference, is first prepared and then reacted with a suitable diamine, such as ethylene diamine, or polyamine to a selected depth wherein the pendant sulfonyl fluoride groups react to form N-monosubstituted sulfonamido groups or salts thereof. The thickness of amine substituted polymers of the first group is in the range from about 4 to about 10 and preferably in the range from about 5 to about 8 mils.

The selected depth is typically in the range from about 1.0 to about 7.0 and preferably from about 1.2 to about 1.5 mils.

In preparing the basic precursor sulfonyl fluoride as described in the U.S. Pat. No. 4,036,714, above, the preferred copolymers utilized in the film are fluoropolymers or polyfluorocarbons although others can be utilized as long as there is a fluorine atom attached to the carbon atom which is attached to the sulfonyl group of the polymer. A preferred copolymer is a copolymer of tetrafluoroethylene and perfluoro (3,6-dioxa-4-methyl- 7-octenesulfonyl fluoride) which comprises 10% to 60% and preferably 25% to 50% by weight of the latter. Surface sulfonyl groups are then converted to form diamine and octyamino groups or salts thereof through the reaction of the diamine, such as ethylene diamine.

With only surface conversion of the sulfonyl halide groups, further conversion of the remaining sulfonyl halide groups to the ionic form is most desirable. The prior art techniques of conversion of the $—SO_2X$ groups with X as chlorine or fluorine may be undertaken such as by hydrolysis. The techniques set forth in Connolly et al., U.S. Pat. No. 3,282,875 and/or Grot, U.S. Pat. No 3,784,399 may be employed. Illustratively, the unconverted sulfonyl groups of the polymer may be converted to the form $—(—SO_2NH)_mQ$ wherein Q is H, $NH_4$, cation of an alkali metal and/or cation of an alkaline earth metal and m is the valence of Q. Preferred definitions of Q include $NH_4$, and particularly sodium or potassium. Additionally, the unconverted sulfonyl groups may be formed to $—(SO_3)_nMe$ wherein Me is a cation and n is the valence of the cation. Preferred definitions of Me include potassium, sodium and hydrogen.

As employed in this disclosure, a di- or polyamine is defined as an amine which contains at least two amino groups with one primary amino group and the second amino group either primary or secondary. Additional amino groups may be present so long as the above-defined amino groups are present.

Specific amines falling within the above definition are included within the disclosure in U.S. Pat. No. 3,647,086, issued to Mizutani et al. on May 7, 1972, which disclosure of amines is incorporated by reference herein.

Typical membranes of the first group prepared from ethylene diamine which may be employed in the process of this invention include (a) a homogeneous film about 7 mils thick of about 1200 equivalent weight perfluorosulfonic acid resin which has been chemically modified by ethylene diamine converting a depth of about 1.5 mils to the perfluorosulfonamide, (b) a homogeneous film about 7 mils thick of 1150 equivalent weight perfluorosulfonic acid resin which has been chemically modified by ethylene diamine converting a depth of about 1.5 mils to the perfluorosulfonamide, and (c) a homogeneous film about 7 mils thick of 1150 equivalent weight perfluorosulfonic acid resin which has been chemically modified by ethylene diamine converting a depth of about 1.2 mils to the perfluorosulfonamide.

For the above-mentioned amine-substituted membranes, a laminated inert cloth supporting fabric may be employed. The thickness of the laminated inert cloth supporting fabric is in the range from about 3 to about 7 and preferably from about 4 to about 5 mils. The inert cloth supporting fabric is typically comprised of polytetrafluoroethylene, rayon, or mixtures thereof.

An example of diamine substituted polymer is a perfluorosulfonic acid polymer comprised of a homogeneous film about 7 mils thick, of about 1150 equivalent weight perfluorosulfonic acid resin which has been chemically modified on one side by ethylene diamine converting a depth of about 1.5 mils of the polymer to perfluorosulfonamide. The unmodified side is laminated to a fabric of polytetrafluoroethylene resin. The fabric is characterized by having a basic weave pattern, a thread count of about 6×6 polytetrafluoroethylene, 24×24 rayon per centimeter, a denier of about 200 polytetrafluoroethylene and 50 rayon, a fabric thickness of about 4.6 mils and an open area (Optical) of about 70% by volume after rayon removed.

The ethylene diamine treated side of the membrane is oriented toward the cathode in the electrolytic cell.

Also included in this first group of membranes are polymers similar to the above U.S. Pat. No. 4,030,988 which are prepared as described in U.S. Pat. No. 4,085,071, supra, wherein surface sulfonyl groups of the backbone sulfonated fluorine polymers are reacted to a selected depth with a primary amine such as with heat treatment of the converted polymer to form N-monosubstituted sulfonamido groups or salts on the sulfonyl fluoride sites of the copolymer through the reaction of the primary amide.

With respect to the diamine or polyamine substituted polymers of the U.S. Pat. No. 4,030,988 and the primary amine polymers of the U.S. Pat. No. 4,085,071 described above, the modifications are generally performed on only one side of the membrane. The thickness of the diamine and polyamine substituted polymers is in the range from about 4 to about 10 and preferably in the range from about 5 to about 9 mils. The depth of the modification is in the range from about 1.0 to about 7.0 and preferably from about 1.2 to about 1.5 mils.

The amine treated side of the membrane is also oriented toward the cathode.

The second group of materials suitable as membranes in the process of this invention includes perfluorosulfonic acid membrane laminates which are comprised of at least two unmodified homogeneous perfluorosulfonic acid films. Before lamination, both films are unmodified and are individually prepared in accordance with the basic U.S. Pat. No. 3,291,714 previously described.

The first film has a thickness in the range from about 0.5 to about 2.0 mils, of about 1500 equivalent weight perfluorosulfonic acid resin, and the second film has a thickness in the range from about 4.0 to about 6.0 mils, of about 1100 equivalent weight perlfuorosulfonic acid resin.

After lamination together to form a single film, the resulting membrane is positioned in the electrolytic cell with the thinner, higher equivalent weight side of the resulting film oriented toward the catholyte chamber.

Typical laminated membranes of the second group which may be employed in the process of this invention include (a) a homogeneous film about 1 mil thick of about 1500 equivalent weight perfluorosulfonic acid resin and a homogoneous film about 5 mils thick of about 1100 equivalent weight perfluorosulfonic acid resin; (b) a homogeneous film about 1.5 mils thick of about 1500 equivalent weight perfluorosulfonic acid resin and a homogeneous film about 5 mils thick of about 1100 equivalent weight perfluorosulfonic acid resin; (c) a homogeneous film about 2 mils thick of about 1500 equivalent weight perfluorosulfonic acid resin and a homogeneous film about 4 mils thick of 1100 equivalent weight perfluorosulfonic acid resin; and (d) a homogeneous film about 1.5 mils thick of about 1500 equivalent weight perfluorosulfonic acid resin and a homogeneous film about 4 mils thick of about 1100 equivalent weight perfluorosulfonic acid resin.

For selected laminated membranes, a laminated inert cloth supporting fabric may be employed. The thickness of the laminated inert cloth supporting fabric is in the range from about 3 to about 7 and preferably from about 4 to about 5 mils. The inert supporting fabric is typically comprised of polytetrafluoroethylene, rayon, or mixtures thereof.

The third group of materials suitable as membranes in the process of this invention includes homogeneous perfluorosulfonic acid membrane laminates. These are comprised of at least two unmodified perfluorosulfonic acid films of 1200 equivalent weight laminated together with an inert cloth supporting fabric of the types described hereinabove.

Typical laminated membranes of the third group which may be employed in the process of this invention include (a) a homogeneous film about 7 mils thick laminated with a "basket weave" of polytetrafluoroethylene fabric and (b) a homogeneous film about 7 mils thick laminated with a "leno weave" with a fabric comprised of polytetrafluoroethylene fibers having rayon fibers interspersed therein.

The fourth group of membranes suitable for use as membranes in the process of this invention include carboxylic acid substituted polymers described in U.S. Pat. No. 4,065,366, issued to Oda et al on Dec. 27, 1977. The teaching of that patent is incorporated herein in its entirety by reference.

The carboxylic acid substituted polymers of U.S. Pat. No. 4,065,366, are prepared by reacting a fluorinated olefin with a comonomer having a carboxylic acid group or a functional group which can be converted to a carboxylic acid group.

The fluorinated olefin monomers and the comonomers having carboxylic acid group or a functional group which can be converted to carboxylic acid group for using the production of the copolymer for the membranes can be selected from the defined groups below.

It is preferable to use monomers for forming the units (a) and (b) in the copolymers.

$$\text{-}(CF_2\text{-}CXX')\text{-} \quad \text{(a)}$$

$$\text{-}(CF_2\text{-}\underset{\underset{Y}{|}}{C}\text{-}X)\text{-} \quad \text{(b)}$$

wherein X represents —F, —Cl, —H or $-CF_3$ and X' represents —F, —Cl, —H, $-CF_3$ or $CF_3(CF_2)_m$—; m represents an integer of 1 to 5 and Y represents —A, —ϕ—A, —P—A, $-O-(CF_2)_n$ (P, Q, R—A; P represents $-CF_2)_a(CXX')_b(CF_2)_c$; Q represents $-CF_2-O-CXX')_d$; R represents $-CXX'-O-CF_2)_e$; (P, Q, R) represents a discretional arrangement of at least one of P, Q and R; ϕ represents phenylene group; X,X' are defined above; n=0 to 1; a, b, c, d and e represent 0 to 6; A represents —COOH or a functional group which can be converted to —COOH by hydrolysis or neutralization such as —CN, —COF, $-COOR_1$, —COOM, $-CONR_2R_3$; $R_1$ represents a $C_{1-10}$ alkyl group; M represents an alkali metal or a quarternary ammonium group and $R_2$ and $R_3$, respectively, represent hydrogen or a $C_{1-10}$ alkyl group.

The typical groups of Y have the structure having A connected to a carbon atom which is also connected to at least one fluorine atom, and include $$\text{-}(CF_2)_x A,\ -O\text{-}(CF_2)_x A,\ -O-CF_2-\underset{\underset{Z}{|}}{CF})_y A,$$

$$\text{-}(O-CF_2-\underset{\underset{Z}{|}}{CF})_x(O-CF_2-CF)_y A,$$

-continued $$-O-CF_2\text{-}(\underset{\underset{Z}{|}}{CF}-O-CF_2)_x\text{-}(CF_2)_y\text{-}(CF_2-O-\underset{\underset{R_f}{|}}{CF})_z A;$$

wherein x, y and z, are respectively, 1 to 10; Z and $R_f$, respectively, represent —F and a $C_{1-10}$ perfluoroalkyl group A is as defined above. In the case of the copolymers having the units (a) and (b), it is preferable to have 1 to 40, especially 30 to 20 mole percent of the unit (b) in order to produce the membrane having an ion-exchange capacity in said range. The molecular weight of the fluorinated copolymer is important because it relates to the tensile strength, the fabricapability, the water permeability and the electrical properties of the resulting fluorinated cation exchange membrane.

Typical carboxylic acid polymers include copolymer of tetrafluoroethylene and $$CF_2{=}CFO-CF_2-\underset{\underset{CF_3}{|}}{CF}-O(CF_2)_3-COOCH_3$$

prepared with a catalyst of azobisisobutyronitrile in trichlorotrifluoroethane to obtain a fluorinated copolymer having an ion exchange capacity of about 1.17 meq/g polymer and a $T_g$, glass transition temperature, of 190° C. press-molded to form a film about 200 microns thick and thereafter hydrolyzed in an aqueous methanol solution of sodium hydroxide, (b) a copolymer of tetrafluoroethylene and $CF_2{=}CFO-(CF_2)_3-COOCH_3$ copolymerized with a catalyst of azobisisobutyronitrile to obtain a fluorinated copolymer having an ion exchange capacity of about 1.45 meq/g polymer and a $T_g$ of about 235° C., press-molded to form a film of thickness about 200 microns and hydrolyzed in aqueous methanol of sodium hydroxide, (c) a copolymer of tetrafluoroethylene and $$CF_2{=}CFO-(CF_2)_3COOCH_3 \quad \text{(A)}$$

$$CF_2{=}CFOCF_2CF(CF_3)O(CF_2)_3COOCH_3 \quad \text{(B)}$$

copolymerized with a catalyst of azobisisobutyronitrile (mole ratio A/B of about 4:1) to obtain a fluorinated copolymer having an ion exchange capacity of about 1.45 meq/g polymer and $T_g$ of about 220° C., press-molded to obtain a film of about 200 microns thickness, and hydrolyzed in an aqueous solution of methanol of sodium hydroxide, and (d) a copolymer of tetrafluoroethylene and $CF_2{=}CFO(CF_2)_3COOCH_3$ were copolymerized with a catalyst of ammonium persulfate in water to obtain a fluorinated copolymer having an ion-exchange capacity of 1.20 meq/g polymer and $T_g$ of 210° C., the copolymer extruded to obtain a film having a thickness of 250 microns and width of 15 centimeters and plied to a cloth made of a copolymer of tetrafluoroethylene and ethylene (50 mesh:thickness 150 microns), compress-molded to form a reinforced film and hydrolyzed in an aqueous methanol solution of sodium hydroxide to obtain a carboxylic acid type fluorinated cation exchange membrane. For selected membranes, a laminated inert cloth supporting fabric having a thickness from about 3 to about 7 and preferably from about 4 to about 5 mils may be employed. This is typically comprised of polytetrafluoroethylene, rayon or mixtures thereof.

EXAMPLES

In each of the examples, electrodes are prepared and tested as cathodes in brine electrolysis test cells. All voltage values quoted herein are based on the use of 200 milliamps per square centimeter current density, although the electrodes are equally suitable for operation over a broad range of other current densities. Unless stated otherwise, all compositions are given as weight percentages.

EXAMPLE 1

Five electrodes were prepared as follows:

1. Mild Steel.

A thoroughly cleaned mild steel coupon.

2. Nickel 200.

A thoroughly cleaned Nickel 200 coupon.

3. Nickel-10 Ruthenium.

A thoroughly cleaned Nickel-10 Ruthenium coupon.

4. β-Raney Ni-Ru on Ni-Ru core (dipped). Three samples of 1.6 mm thick Ni-Ru alloy sheet, assaying respectively 5, 10, and 15% Ru by weight balance Ni were cut into coupons measuring about one $cm^2$. Each coupon was thoroughly cleaned by degreasing with acetone, lightly etching with 10 percent HCl, rinsing with water and after drying, grit blasting with No. 24 grit $Al_2O_3$ at a pressure of 3.4 $kg/cm^2$ (50 psi).

The cleaned nickel alloy coupons were aluminized by applying a commercial flux and then dipping in a pot of molten aluminum at a temperature of 650° C.–675° C. for 1–2 minutes which was adequate to entirely coat the coupon with aluminum.

The aluminized nickel alloy coupons were heat treated at 725° C. for 5 minutes in a nitrogen atmosphere to interdiffuse the nickel and aluminum and form a surface layer which is predominantly Beta structured nickel-ruthenium aluminide in its outermost reaches with some Gamma structured nickel-ruthenium alloy in the interior portions. After heat treating, the coupons were allowed to cool in a current of nitrogen for about 2 hours. This produced a predominantly Beta structured interdiffused layer.

The cooled coupons were then subjected to a caustic leaching treatment wherein the aluminum was selectively removed from the interdiffused layer to leave an active porous Raney nickel alloy surface thereon. The leaching treatment consisted of immersing the interdiffused coupon in 10 percent NaOH for 20 hours, without temperature control, followed by 2 hours in 30 percent NaOH at 80° C. The coupons were then rinsed with water for 30 minutes.

5. β-Raney Nickel on Nickel 200 (core dipped)

A 1–2 mm sheet of Nickel 200 cut into coupons measuring about one $cm^2$. Each coupon was thoroughly cleaned by degreasing with acetone, lightly etching with 10 percent HCl, rinsing with water and after drying, grit blasting with No. 24 grit $Al_2O_3$ at a pressure of 3.4 $kg/cm^2$ (50 psi).

The cleaned nickel coupons were aluminized by applying a commercial flux and then dipping in a pot of molten aluminum at a temperature of 650° C.–675° C. for 1–2 minutes which is adequate to entirely coat the coupon with aluminum.

The aluminized nickel coupons were heat treated at 725° C. for 5 minutes in a nitrogen atmosphere to interdiffuse the nickel and aluminum and form a layer which was predominantly Beta phase ($NiAl_3$) nickel aluminide in its outermost reaches with some Gamma structured ($Ni_2Al_3$) alloy in the interior portions. After heat treating, the coupons were allowed to cool in a current of nitrogen for about 2 hours. This produced a predominantly $NiAl_3$ Beta structured interdiffused layer.

The cooled coupons were then subjected to a caustic leaching treatment wherein the aluminum is selectively removed from the interdiffused layer to leave an active porous Raney nickel alloy surface thereon. The leaching treatment comprised immersing the interdiffused coupon in 10 percent NaOH for 20 hours, without temperature control, followed by 2 hours in 30 percent NaOH at 80° C. The coupons were then rinsed with water for 30 minutes.

Coupons from treatments 1, 4 and 5 were tested as cathode 11 in test cell 1 of FIG. 6 in accordance with the above-described procedure.

The cathode potentials were monitored for 45 days to determine if the potential experienced a steady increase or instead leveled out at some value.

The results are plotted in FIG. 1. It is seen that Raney Ni-Ru coupons of treatment 4 had a surprisingly lower hydrogen overvoltage than both the Raney Ni of coupon 5 and the mild steel of coupon 1. Furthermore the level of reduction achieved was essentially the same whether a 5, 10 or 15% ruthenium precursor nickel alloy was used and that this effect persisted throughout the 45 day test period. At the conclusion of the run the mild steel electrode had stabilized at about a hydrogen overvoltage of about −1.38 V and the Raney nickel at about −1.16 V. The nickel ruthenium coupon voltages while slightly rising were at about −1.08 V or about 0.3 V below the steel of coupon 1 and about 0.08 V below unstabilized (unalloyed) B Raney nickel.

EXAMPLE 2

The cathode polarization potentials of coupons prepared by treatments 1, 2, and 5 and a Ni-10Ru coupon of treatment 4 of Example 1 were measured relative to a standard hydrogen electrode (S.H.E.) over a current density range of from about 1 to about 200 $ma/cm^2$ at 85° C. in a solution comprised of 15% NaCl, 11% NaOH and 0.1% $NaClO_3$. This is typical of catholyte solutions produced in many commercial chlor-alkali diaphragm cells. The results, illustrated in FIG. 2, show that at 200 $ma/cm^2$ the potential values for the steel and nickel 200 coupons of treatments 1 and 2 were between −1.3 and −1.4 V while values for the B Raney treated Ni-10Ru and Ni coupons of treatments 4 and 5 ranged between −0.9 and −1.0 V with the Ni-10Ru coupon of treatment 4 being consistently the lowest.

EXAMPLE 3

The cathode polarization potentials of steel and Ni-10Ru coupons prepared by treatments 1 and 3 and a B Raney Ni-10Ru coupon were measured relative to a standard hydrogen electrode (S.H.E.) over a current density range of from about 1 $ma/cm^2$ to about 200 $ma/cm^2$ in a solution consisting of 21.4% NaOH typical of a catholyte solution produced in a membrane cell. The results, illustrated in FIG. 3, show that at 200 $ma/cm^2$ the B Raney Ni-10Ru coupons of treatment 4 were about 0.3 V lower than either the mild steel or unRaneyized Ni-10Ru alloy values.

EXAMPLES 4–6

Electrodes were prepared as in treatments 4 and 5 of Example 1 except that the aluminum was applied by plasma spraying instead of dipping with all other conditions of heat treatment and leaching being the same. No changes in the polarization potentials were observed.

It will be understood that the above description of the present invention is susceptible to various modifications, changes, and adaptations, and the same are intended to be comprehended within the meaning and range of equivalents of the appended claims.

What is claimed is:

1. A method of producing a low overvoltage electrode for use as a hydrogen evolution cathode in an electrolytic cell which comprises the steps of:

(a) coating with aluminum the surface of a clean non-porous conductive base metal structure, said surface comprising a nickel-ruthenium alloy having a weight percent ruthenium within the range of from 5 to about 15 and a weight percent nickel within the range of from about 95 to about 85;

(b) heat treating said coated surface by maintaining said surface at a temperature within the range of from about 660° to about 750° C. for a time from about 1 minute to about 30 minutes to interdiffuse a portion of said aluminum into the outer portions of said surface to produce an integral nickel-ruthenium-aluminum Beta structured ternary alloy layer in said outer portions consisting predominantly of Beta structured grains and further having an inner portion consisting predominantly of Gamma structured grains in said alloy layer; and (c) leaching out the residual aluminum and intermetallics from said interdiffused alloy layer until a Raney nickel ruthenium layer is formed integral with said structure.

2. The method of claim 1 wherein said surface alloy contains from about 8 to about 12 percent ruthenium and from about 92 to about 88 percent nickel by weight.

3. The method of claim 1 wherein said aluminum coating is applied to a thickness of from about 100 to about 500 microns.

4. The method of claim 3 wherein said aluminum coating is between about 150 to about 300 microns thick.

5. The method of claim 1 further comprising the additional step of coating said clean non-porous surface with a low melting flux prior to step (a).

6. The method of claim 5 wherein step (a) comprises dipping said base metal structure into molten aluminum at a temperature within the range of from about 650° to about 750° C.

7. The method of claim 6 wherein the time for said dipping is from about 0.5 to about 2 minutes.

8. The method of claim 1 wherein said coating is applied by plasma spraying a coating of molten aluminum onto said surface.

9. The method of claim 1 wherein said heat treating time is between about 5 to about 20 minutes.

10. The method of claim 1 wherein said heat treating temperature is maintained between the range of from about 700° to about 750° C.

11. The method of claim 10 wherein said heat treating temperature is maintained within the range of from about 715° to about 735° C.

12. The method of claim 1 wherein said said interdiffused surface layer is from about 100 to about 400 microns thick.

13. The method of claim 12 wherein said interdiffused surface layer is from about 150 to about 300 microns thick.

14. The method of claim 1 wherein said heat treating is carried out in an inert atmosphere.

15. The method of claim 1 further comprising chemically treating said leached surface layer by immersing said structure in a dilute aqueous solution of an oxidizing agent.

16. The method of claim 1 further comprising coating said leached nickel ruthenium layer with a nickel layer having a thickness of from about 5 to about 10 microns.

17. The method of claim 1 wherein said leached interdiffused layer is between 35 and 65 microns thick.

18. A method of substantially eliminating high overvoltage metal fouling of the surface of a cathode in an electrolytic cell which comprises the steps of employing in said cell a cathode having as said cathode surface a Beta phase crystal structured surface coating of the general formula $(Ni\text{-}Ru)Al_3$ where the weight percent of ruthenium in the combined weight of nickel and ruthenium ranges from about 5 to about 15, and leaching from about 75 to about 95 percent of the aluminum from said surface with a strong aqueous alkali metal hydroxide solution to form an active nickel-ruthenium alloy surface layer wherein the hydrogen overvoltage of said cathode is reduced to a non-fouling level.

19. The method of claim 18 wherein the formation of said Beta phase crystal structure comprises the steps of:

(a) coating with aluminum the surface of a clean non-porous conductive base metal structure, said surface comprising a nickel-ruthenium alloy having a weight percent ruthenium within the range of from 5 to about 15 and a weight percent nickel within the range of from about 95 to about 85;

(b) heat treating said coated surface by maintaining said surface at a temperature within the range of from about 660 to about 750° C. for a time from about 1 minute to about 30 minutes to interdiffuse a portion of said aluminum into the outer portions of said surface to produce an integral nickel-ruthenium-aluminum Beta structured ternary alloy layer in said outer portions consisting predominantly of Beta structured grains and further having an inner portion consisting predominantly of Gamma structured grains in said alloy layer; and (c) leaching out the residual aluminum and intermetallics from said interdiffused alloy layer until a Raney nickel ruthenium layer is formed integral with said structure.

20. In a method of electrolyzing an alkali metal chloride brine comprising passing an electrical current from an anode to a cathode to evolve chlorine at said anode and hydrogen at said cathode, said cathode comprising an electroconductive substrate having porous surface comprising a major portion of nickel; the improvement which comprises employing as said porous surface a Raney nickel surface being predominantly derived from an adherent Beta crystalline precursory surface layer formed from an alloy of nickel and ruthenium wherein the weight percentage of nickel in said alloy is no more than 95; said Raney surface being prepared by the steps of:

(a) coating with aluminum the surface of a clean non-porous conductive base metal structure, said surface comprising a nickel-ruthenium alloy having a weight percent ruthenium within the range of from 5 to about 15 and a weight percent nickel within the range of from about 95 to about 85;

(b) heat treating said coated surface by maintaining said surface at a temperature within the range of from about 660° to about 750° C. for a time from about 1 minute to about 30 minutes to interdiffuse a portion of said aluminum into the outer portions of said surface to produce an integral nickel-ruthenium-aluminum Beta structured ternary alloy layer in said outer portions consisting predominantly of Beta structured grains and further having an inner portion consisting predominantly of Gamma structured grains in said alloy layer; and (c) leaching out the residual aluminum and intermetallics from said interdiffused alloy layer until a Raney nickel-ruthenium layer is formed integral with said structure.

21. In a method of electrolyzing an alkali metal chloride brine comprising passing an electrical current from an anode to a cathode to evolve chlorine at said anode and hydrogen at said cathode, said cathode comprising an electroconductive substrate having porous surface comprising a major portion of nickel; the improvement which comprises employing as said porous surface a catalytic Raney nickel surface being predominantly derived from an adherent Beta crystalline precursory surface layer formed from an alloy of nickel and ruthenium wherein the weight percentage of nickel in said alloy is no more than 95; said Raney surface being prepared by the steps of:

(a) coating with aluminum the surface of a clean nonporous conductive base metal structure, said surface comprising a nickel-ruthenium alloy having a weight percent ruthenium within the range of from 5 to about 15 and a weight percent nickel within the range of from about 95 to about 85;

(b) heat treating said coated surface by maintaining said surface at a temperature within the range of from about 660° to about 750° C. for a time from about 1 minute to about 30 minutes to interdiffuse a portion of said aluminum into the outer portions of said surface to produce an integral nickel-ruthenium-aluminum Beta structured ternary alloy layer in said outer portions consisting predominantly of Beta structured grains and further having an inner portion consisting predominantly of Gamma structured grains in said alloy layer; and (c) leaching out the residual aluminum and intermetallics from said interdiffused alloy layer until a Raney nickel-ruthenium layer is formed integral with said structure.

22. In a method of electrolyzing an alkali metal chloride brine comprising passing an electrical current from an anode to a cathode to evolve chlorine at said anode and hydrogen at said cathode, said cathode comprising an electroconductive substrate having porous Raney surface comprising a major portion of nickel; the improvement which comprises employing an electroconductive substrate having a stabilized porous surface being predominantly derived from an adherent Beta crystalline precursory surface layer formed from an alloy of nickel and ruthenium wherein the weight percentage of nickel in said alloy is no more than 95; said Raney surface being prepared by the steps of:

(a) coating with aluminum the surface of a clean nonporous conductive base metal structure, said surface comprising a nickel-ruthenium alloy having a weight percent ruthenium within the range of from 5 to about 15 and a weight percent nickel within the range of from about 95 to about 85;

(b) heat treating said coated surface by maintaining said surface at a temperature within the range of from about 660° to about 750° C. for a time from about 1 minute to about 30 minutes to interdiffuse a portion of said aluminum into the outer portions of said surface to produce an integral nickel-ruthenium-aluminum Beta structured ternary alloy layer in said outer portions consisting predominantly of Beta structured grains and further having an inner portion consisting predominantly of Gamma structured grains in said alloy layer; and (c) leaching out the residual aluminum and intermetallics from said interdiffused alloy layer until a Raney nickel-ruthenium layer is formed integral with said structure.

23. In an electrolytic cell comprising an anode, a cathode, and a separator therebetween the improvement which comprises employing as said cathode an electroconductive substrate having a porous surface comprised of a Raney metal surface derived from an adherent Beta crystalline precursory surface layer formed from an alloy of nickel and ruthenium wherein the weight percentage of nickel in said alloy is no more than 95; said Raney surface being prepared by the steps of:

(a) coating with aluminum the surface of a clean nonporous conductive base metal structure, said surface comprising a nickel-ruthenium alloy having a weight percent ruthenium within the range of from 5 to about 15 and a weight percent nickel within the range of from about 95 to about 85;

(b) heat treating said coated surface by maintaining said surface at a temperature within the range of from about 660° to about 750° C. for a time from about 1 minute to about 30 minutes to interdiffuse a portion of said aluminum into the outer portions of said surface to produce an integral nickel-ruthenium-aluminum Beta structured ternary alloy layer in said outer portions consisting predominantly of Beta structured grains and further having an inner portion consisting predominantly of Gamma structured grains in said alloy layer; and (c) leaching out the residual aluminum and intermetallics from said interdiffused alloy layer until a Raney nickel ruthenium layer is formed integral with said structure.

24. The cell of claim 23 wherein said separator is a diaphragm.

25. The cell of claim 23 wherein said separator comprises a permselective cation exchange membrane selected from a class consisting of amine substituted polymers, unmodified perfluorosulfonic acid laminates, homogeneous perfluorosulfonic acid laminates and carboxylic acid substituted polymers.

26. The cell of claim 25 wherein said membrane is an amine substituted polymer.

27. The cell of claim 25 wherein said membrane is an unmodified perfluorosulfonic acid laminate.

28. The cell of claim 25 wherein said membrane is a homogeneous perfluorosulfonic acid laminate.

29. The cell of claim 25 wherein said membrane is a carboxylic substituted polymer.

* * * * *